US009449756B2

(12) United States Patent
Calvin et al.

(10) Patent No.: US 9,449,756 B2
(45) Date of Patent: Sep. 20, 2016

(54) ELECTROMAGNETIC CONNECTORS

(71) Applicant: Bedrock Automation Platforms Inc., San Jose, CA (US)

(72) Inventors: James Calvin, Attleboro, MD (US); Albert Rooyakkers, Sunnyvale, CA (US)

(73) Assignee: Bedrock Automation Platforms Inc., San Jose, CA (US)

( * ) Notice: Subject to any disclaimer, the term of this patent is extended or adjusted under 35 U.S.C. 154(b) by 522 days.

(21) Appl. No.: 13/875,858

(22) Filed: May 2, 2013

(65) Prior Publication Data

US 2014/0327318 A1 Nov. 6, 2014

(51) Int. Cl.

| | |
|---|---|
| ***H01F 38/00*** | (2006.01) |
| ***H01F 38/14*** | (2006.01) |
| ***H01F 41/02*** | (2006.01) |

(52) U.S. Cl.

CPC ..... *H01F 38/14* (2013.01); *H01F 41/02* (2013.01); *Y10T 29/49071* (2015.01)

(58) Field of Classification Search

USPC ..... 307/104

See application file for complete search history.

(56) References Cited

U.S. PATENT DOCUMENTS

| | | | | |
|---|---|---|---|---|
| 4,082,984 | A | 4/1978 | Iwata | |
| 5,229,652 | A | 7/1993 | Hough | |
| 5,469,334 | A | 11/1995 | Balakrishnan | |
| 5,719,483 | A | 2/1998 | Abbott et al. | |
| 5,958,030 | A | 9/1999 | Kwa | |
| 6,009,410 | A | 12/1999 | LeMole et al. | |
| 6,124,778 | A | 9/2000 | Rowley et al. | |
| 6,812,803 | B2 | 11/2004 | Goergen | |
| 6,828,894 | B1 | 12/2004 | Sorger et al. | |
| 6,988,162 | B2 | 1/2006 | Goergen | |
| 7,164,255 | B2 * | 1/2007 | Hui | H01F 17/0006 320/108 |
| 7,839,025 | B2 | 11/2010 | Besser et al. | |
| 7,872,561 | B2 | 1/2011 | Matumoto | |
| 7,960,870 | B2 | 6/2011 | Besser et al. | |
| 8,013,474 | B2 | 9/2011 | Besser et al. | |
| 8,212,399 | B2 | 7/2012 | Besser et al. | |

(Continued)

FOREIGN PATENT DOCUMENTS

| | | |
|---|---|---|
| EP | 1885085 | 2/2008 |
| EP | 2317743 | 5/2011 |

(Continued)

OTHER PUBLICATIONS

"International Search Report and Written Opinion of the International Searching Authority Dated Apr. 29, 2013, International Application No. PCT/US2012/072056", (Apr. 29, 2013).

*Primary Examiner* — Rexford Barnie
*Assistant Examiner* — Dru Parries
(74) *Attorney, Agent, or Firm* — Advent, LLP

(57) ABSTRACT

An electromagnetic connector well suited for use in harsh environments. The connector used an E-core or C-core magnetic members for coupling power such as from a backplane to a module mounted on the backplane and using I-cores for coupling signals to and from the module. Separation of the power and signaling allows optimization of each coupling without compromise in performance of each function. Use of I-cores for signal coupling provides efficient use of space, with the use of E-cores or C-cores providing maximum power coupling to the module in a minimum space. Various aspects of exemplary embodiments are disclosed.

54 Claims, 10 Drawing Sheets

(56) References Cited

U.S. PATENT DOCUMENTS

| | | | |
|---|---|---|---|
| 8,380,905 | B2 | 2/2013 | Djabbari et al. |
| 2002/0171525 | A1 | 11/2002 | Kobayashi et al. |
| 2003/0094855 | A1 | 5/2003 | Lohr et al. |
| 2003/0202330 | A1 | 10/2003 | Lopata et al. |
| 2007/0072442 | A1 | 3/2007 | Difonzo et al. |
| 2007/0177298 | A1 | 8/2007 | Jaatinen et al. |
| 2008/0123669 | A1 | 5/2008 | Oliveti et al. |
| 2008/0194124 | A1 | 8/2008 | Di Stefano |
| 2010/0233889 | A1 | 9/2010 | Kiani et al. |
| 2011/0074349 | A1 | 3/2011 | Ghovanloo |
| 2011/0140538 | A1* | 6/2011 | Jung ..... H02J 7/0027 307/104 |
| 2012/0274273 | A1 | 11/2012 | Jacobs et al. |
| 2012/0295451 | A1 | 11/2012 | Hyun-jun et al. |
| 2013/0170258 | A1 | 7/2013 | Calvin et al. |

FOREIGN PATENT DOCUMENTS

| | | |
|---|---|---|
| JP | 59-177226 | 11/1984 |
| JP | 2002359131 | 12/2002 |
| JP | 2003-047912 | 2/2003 |
| WO | 2013102069 | 7/2013 |

* cited by examiner

ELECTROMAGNETIC CONNECTORS

BACKGROUND OF THE INVENTION

1. Field of the Invention

The present invention relates to the field of electrical connectors.

2. Prior Art

The preferred embodiments of the present invention are used as connectors between backplanes and modules mounted on the backplanes, and accordingly the prior art relating to such connectors will be discussed. However it is to be understood that use of the present invention is not so limited, and the invention may be adapted for as wide range of use.

Electrical connectors of various sizes and configurations are well known in the art. Multiple pin connectors usually use a multiple pin male connector member that plugs into a female receptacle, with the electrical connections depending on direct metal to metal contact to complete the circuits. For most applications, connectors of this type are satisfactory, though can cause connection failures on initial installation by pin bending on the male connector, or over a period of time as dirt and corrosion build up.

For high reliability applications and in harsh environments, such as for under water use, high humidity and dusty or dirty environments, typically the connector housings are round and include an alignment feature plus a rotary collar on one connector member that screws onto the other connector member to maintain positive engagement of the connector members, with an O-ring providing the ultimate seal of the pins and sockets in the connector.

However, in some instances, physical constraints and other considerations prevent the use of such an O-ring sealed connector. One such application of connectors is in backplane applications wherein a relatively large number of boards or modules must be "plugged" into a backplane, typically side by side with very little space between them. In that regard, as used herein, unless the context indicates otherwise, a backplane is a printed circuit board into which boards or modules are "plugged", which backplane printed circuit board provides power to and/or communication with the module or printed circuit mounted on the backplane printed circuit board, or the entire assembly that includes such a backplane printed circuit board.

A simple edge connector is adequate for applications wherein one can be assured that the environment will not be hostile. For applications that require high reliability and lack of a harsh environment cannot be assured, such as in industrial process control applications, circuit failure detection techniques and/or error detection and correction techniques are commonly used, as is redundancy in circuitry to provide high reliability in circuit operation over long periods of time. However, corrosion is a persistent problem and may render an initially good contact nonfunctional, as such assemblies may sit almost indefinitely without attention until a failure does occur. Therefore conventional connectors remain a weak link in the overall system.

DETAILED DESCRIPTION OF THE PREFERRED EMBODIMENTS

In the description to follow, exemplary embodiments for electrically connecting modules to backplanes are described, though the invention is also suitable for many other uses. In that description, references are made to primary windings and secondary windings. As a matter of convention, when references are made to primary and secondary windings, a primary winding refers to a winding on the backplane, whereas a secondary winding is a winding in the module. In the case of power transfer, this convention is traditional. However in the case of signal transfer, this convention may or may not be traditional, depending on the direction of the signaling, and in the case of bidirectional signaling, is arbitrary. Further, the word module as used herein is used in a most general sense.

Figure 1:
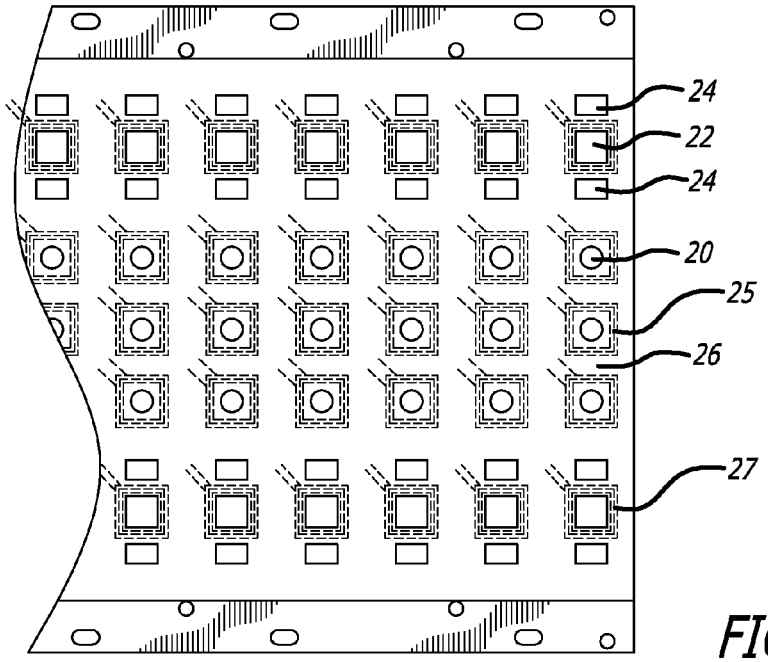
FIG. 1 illustrates a section of a backplane circuit board in accordance with one embodiment of the present invention.

Referring to FIG. 1, a section of a backplane circuit board 26 in accordance with one embodiment of the present invention may be seen. In accordance with that Figure, a typical backplane circuit board 26 in accordance with this embodiment will have a plurality of openings or holes 20 there through, each for the receipt of an I-core during assembly of the backplane, together with one or more groups of openings 22 and 24, each for receipt of an E-core.

An I-core of the type preferably used will be in the form of a round cylindrical slug of magnetic material, in a preferred embodiment a ferrite suitable for use at high frequencies. The E-cores of a typical embodiment will be conventional E-cores, in the embodiment being described, also ferrite E-cores which may be the same grade of ferrite or a different grade of ferrite than the I-cores. In that regard, the E-core devices are used for the transfer of power to a module "plugged" into the backplane using a connector in accordance with an embodiment of the present invention, whereas the I-core devices are used for communication purposes. Accordingly, preferably the E-core ferrite (or other material) will be selected for its relatively high saturation density for best power transfer, whereas the I-core ferrite (or other material) will be selected for its high frequency capabilities to assure maximum signal communication bandwidth. Consequently, one aspect of this invention is the separation of the power and signal transfer rather than trying to transfer power and signals in a single magnetic device, and also the optional use of different magnetic materials, preferably the use of different grades of ferrite, for the power and signal transfer devices to allow maximizing the performance of each.

The backplane circuit board 26 of FIG. 1 will typically be a multilayer board with planar (printed) windings 25 and 27 on each of the multiple layers connected in series with the same winding sense to achieve multiple turn windings, each associated with an I-core opening 20 or the center opening 22 of an E-core opening group 22, 24. Such planar windings are well known and may be formed, by way of example, by forming printed helical or modified helical conductive traces 25 of opposite winding sense on alternate layers of the multilayered printed circuit board 26 and then by connecting the inner ends of the conductive traces of the first and second layers, the outer ends of the conductive traces on the second and third layers, etc. This forms a series connection of the conductive traces on multiple layers, all effectively acting with the same winding sense as interconnected. Such interconnection may be by way of example by the use of plated through holes at different locations (angles) around the inner and outer peripheries of the windings. Alternatively, the interconnector may be made as between alternate board layers as the multilayer circuit board is fabricated. By using such a winding, the total number of turns that may be achieved, while less than a typical wire wound coil, can still be substantial. Of course alternatively, for the E-cores, the planar windings could be around either or both regions 24, or around both regions 24 and 22 as long as they were properly interconnected to achieve the required complementary winding sense.

Figure 2:
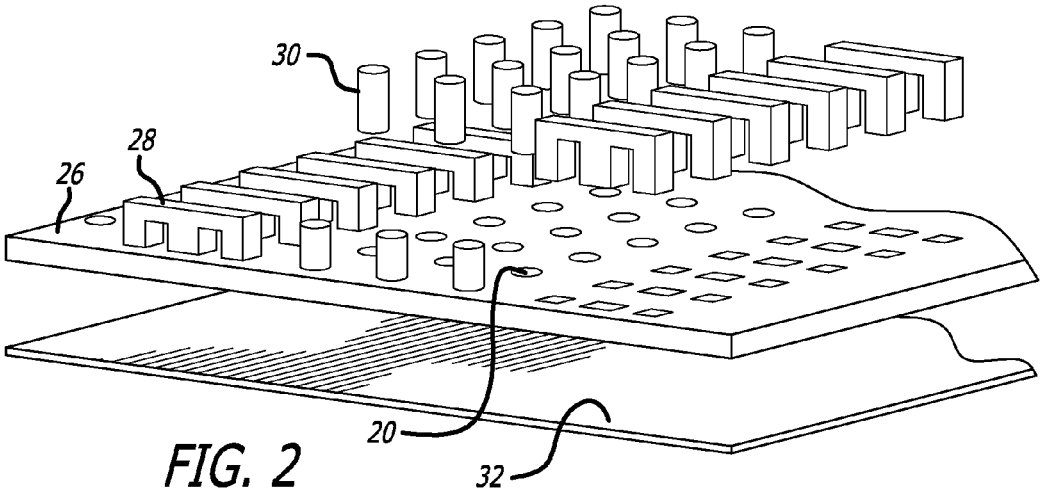
FIG. 2 illustrates a section of the circuit board of FIG. 1 with E-cores and I-cores placed therein.

Now referring to FIG. 2, a section of the circuit board 26 with E-cores 28 and I-cores 30 placed therein. In one embodiment, a label 32 with an adhesive on the top surface thereof is placed under the circuit board 26 and the E-cores 28 and I-cores 30 are placed in position in the board 32 by a typical pick-and-place machine, with the E-cores and I-cores strongly adhering to the adhesive side of the label 32. In that regard, the openings in the printed circuit board 26 are slightly larger than the E-cores 28 and I-cores 30 so as to leave some gap around the cores for subsequent filling by an appropriate potting compound. The potting compound may be a hard potting compound such as an epoxy or alternatively may be a flexible potting compound such as a silicon rubber. A silicon rubber will provide some flexibility between the E-cores 28 and I-cores 30 and the backplane printed circuit board 26, if needed. However such flexibility may not be needed in that the combination of the printed circuit board and a rigid potting material makes the printed circuit board very rigid to avoid backplane flexing. Also the backplane printed circuit board will not be subject to the relatively high forces of prior art backplane printed circuit boards because of the absence of any high forces thereon required for full prior art connector engagement, though vibration may be encountered in some applications. In the claims to follow, materials such a epoxy and silicon rubber are considered positive mounts for the respective cores because they hold the cores in place, as opposed to being spring mounted to accommodate meaningful deflection under force.

Of course once completed, the assembled backplane printed circuit board 26 will in turn become part of a larger assembly forming some part of a support chassis which may vary considerably, depending on the application. In the present invention, the E-cores 28 on the backplane printed circuit board 26 (FIG. 2) meet with a respective E-core in a module to be connected to the backplane. Since in preferred embodiments such E-cores are used for the transfer of AC power from the backplane to a module mounted on the backplane, highly efficient energy transfer from the primary planar windings 25 on the backplane multilayer printed circuit board 26 to the wire windings on the E-cores in the module requires a minimum gap in the magnetic circuit formed by that E-core pair. This in turn requires a minimum gap (minimum non-magnetic spacing) between the E-cores 28 on the printed circuit board 26 and the respective E-cores in the module connector, except as required by the protection for the E-cores 28 provided by the label 32 on the backplane printed circuit board 26 and by similar protection for the complementary E-cores in a module. In one embodiment, the label 32 is a 0.005 inch Lexan label on the backplane printed circuit board 26 and a corresponding Lexan member protecting the E-cores in the module. Note that a 0.005 inch protection of each leg of each E-core itself causes a 0.020 gap in the magnetic circuit formed by an E-core pair. If the E-cores in both the backplane printed circuit board 26 and in the module were positively fixed in position, that would require providing extra spacing to allow for a variation in that fixed position, both initially and due to thermal expansion and warpage effects that might be caused by heat generated in the module. Accordingly in accordance with some embodiments of the present invention, the E-cores in the module connector are spring loaded so as to slightly protrude from the mounting plane of the module to lie flat against the respective E-cores on the backplane printed circuit board 26 (of course with their protective layers there between) with the spring depressing as required when the module is located in its final position. This spring loading assures a constant minimum gap defined by the protective layers over the E-cores in spite of the differential expansion, warpage in the assembly, vibration, etc., yet very much limits the pressure on the E-cores regardless of such factors.

Figure 3A:
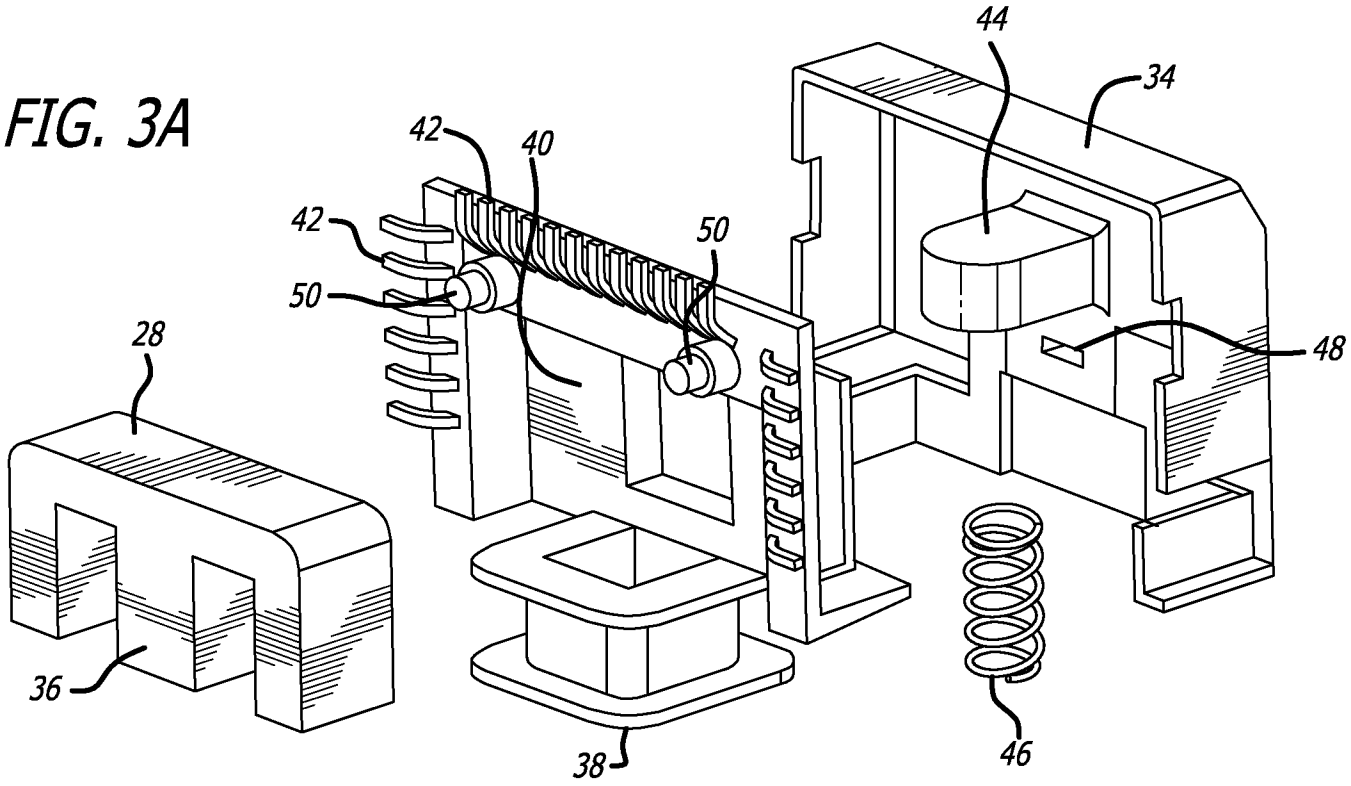
FIG. 3A is an exploded view of the E-core assembly used in one embodiment for the module side of the connector.

FIG. 3A is an exploded view of the E-core assembly used in one embodiment for the module side of the connector. For purposes of illustration, the exploded view is shown with the face of the E-core directed downward, though in the actual assembly the face of the E-core 28 would be directed outward beyond the edge of a printed circuit board in the module, with cover 34 covering most of the E-core. The center leg 36 of the E-core passes through winding bobbin 38 on member 40 which in turn has a number of electrical contacts or terminals 42 around the edge thereof. These terminals, when soldered to a printed circuit board in the module, become the support for the assembly and also act as the terminals to which the leads on the wire wound coil on bobbin 38 are connected. In that regard, a single coil with multiple taps on the coil is typically used to provide various AC voltage outputs which then are converted to associated DC voltages as typically required for operation of a module. As an alternative, the planar and wire wound windings might be instead placed around the outer legs, though this is not preferred, as it does not package as well as the single winding around the center legs.

After bobbin 38 is wound, member 40 is assembled thereto and the center leg 36 of E-core 28 is inserted through the center of bobbin 38. Also a spring 46 is compressed against member 44 and temporarily held in the compressed state by a thin blade inserted through slot 48 in cover 34 so that the cover 34 with compressed spring 46 may be placed over the assembly comprising E-core 28, bobbin 38 and member 40. Then the spring 46 is released so that the spring will encourage E-core 28 away from member 44, yet will allow E-core 28 some movement, relative to the bobbin, against the force of the spring 46 when it contacts the associated E-core on the backplane through the protective layers over the face of each E-core. While such movement is not substantial and bobbins are typically not abrasive, a very thin protective coating may be put over the E-core if desired, at least all except the outward extending face of the E-core, such as, by way of example, by dipping the E-core in a very thin epoxy or other binder.

The assembly of cover 34 with compressed spring 46 to the rest of the assembly shown in FIG. 3A may be done before terminals 42 are soldered to the printed circuit board in the module, or alternatively, after the assembly of E-core 28 and bobbin 38 in member 40 with terminals 42 thereon. In that regard, pins 50 on member 40 extend into holes in the printed circuit board in the module to provide accurate alignment of the assembly with the circuit board 26 without relying on the soldered terminals 42 for positioning the assembly.

Figure 4:
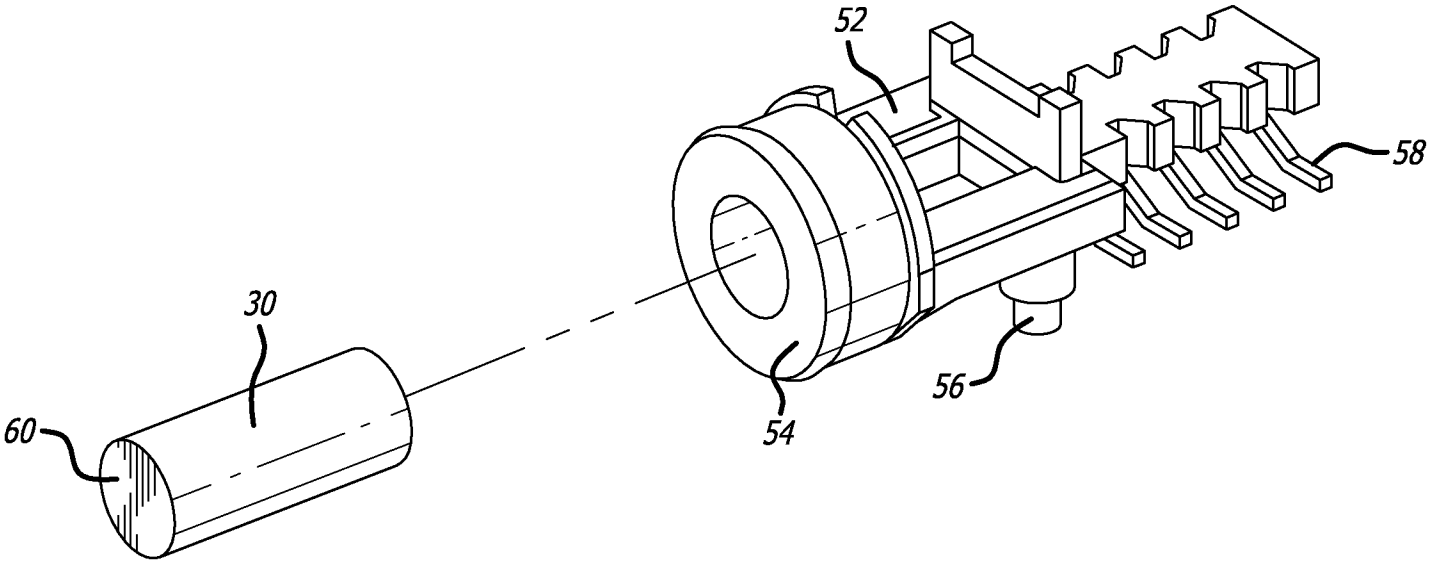
FIG. 4 illustrates the winding bobbin on a support for the I-cores.

Now referring to FIG. 4, the winding bobbin 54 on a support 52 for the I-cores 30 may be seen. In the case of the I-cores, two I-cores end to end do not make a complete magnetic circuit, but instead depend on completion of the magnetic circuit (a return path) through air or non-magnetic materials surrounding the I-cores. Consequently because part of the magnetic circuit is made up of non magnetic materials anyway, communication through the I-cores is not nearly as sensitive to the gap between the respective pair of I-cores as is power transfer through the gap between the power transferring E-cores during operation of the connector. Therefore the I-cores 30 in the connector in the module are positively mounted to the circuit board in the module to always provide some gap between the I-cores beyond that provided by the protective layers over the adjacent ends thereof to prevent them from ever interfering with each other when a module is mounted to the backplane. Accordingly as shown in FIG. 4, a plastic member 52 is molded with an integral winding bobbin 54 and locating pin 56 with conductors 58 being either molded in or attached thereto. The pin 56, like pins 50 of FIG. 3A, provide a locating reference relative to a corresponding hole in the printed circuit board with terminals or supporting feet 58 providing mounting support much like terminals 42 of FIG. 3A. In that regard, while multiple terminals 58 are shown, most are simply used for support, as unlike the secondary on the S-cores which typically has multiple taps, a single coil without taps is used for the secondary winding on the I-cores 30.

Once the bobbin 54 is wound, the I-core 30 is cemented into member 52 with the end 60 being flush with the face of the bobbin 54.

Figure 5:
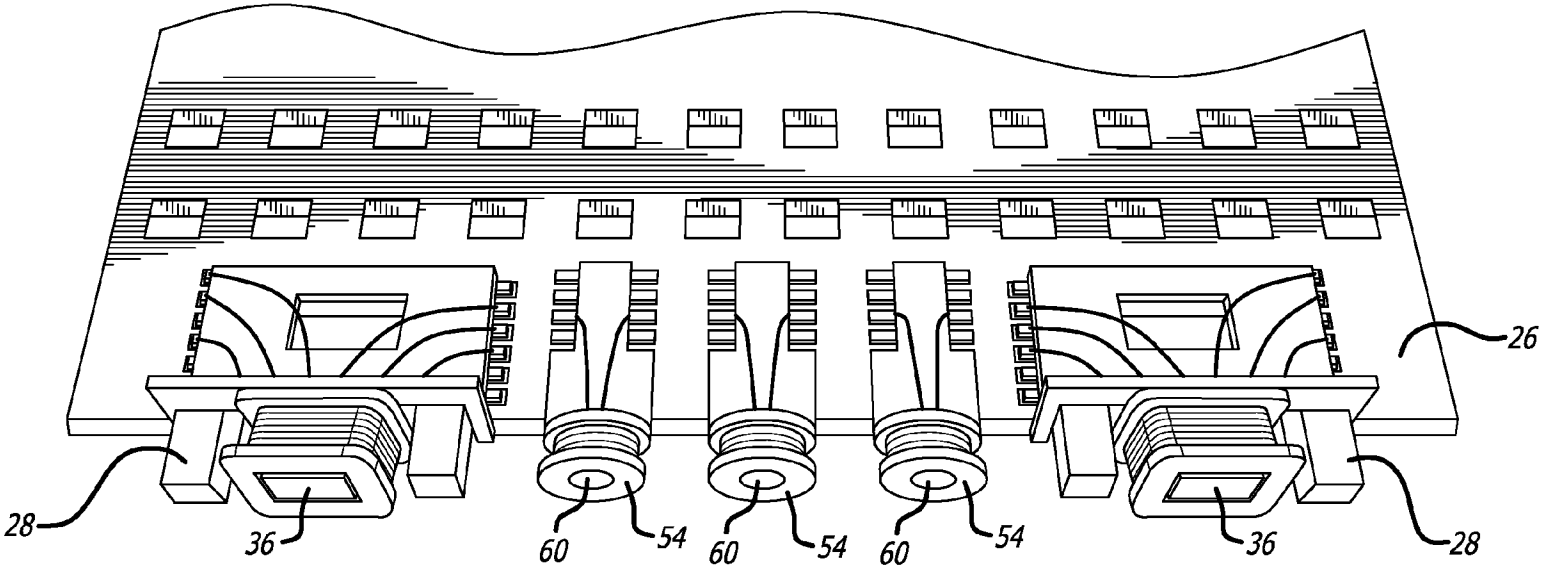
FIG. 5 is a perspective view of a module connector E-core and I-core assemblies on an edge of a circuit board in the module.
Figure 6:
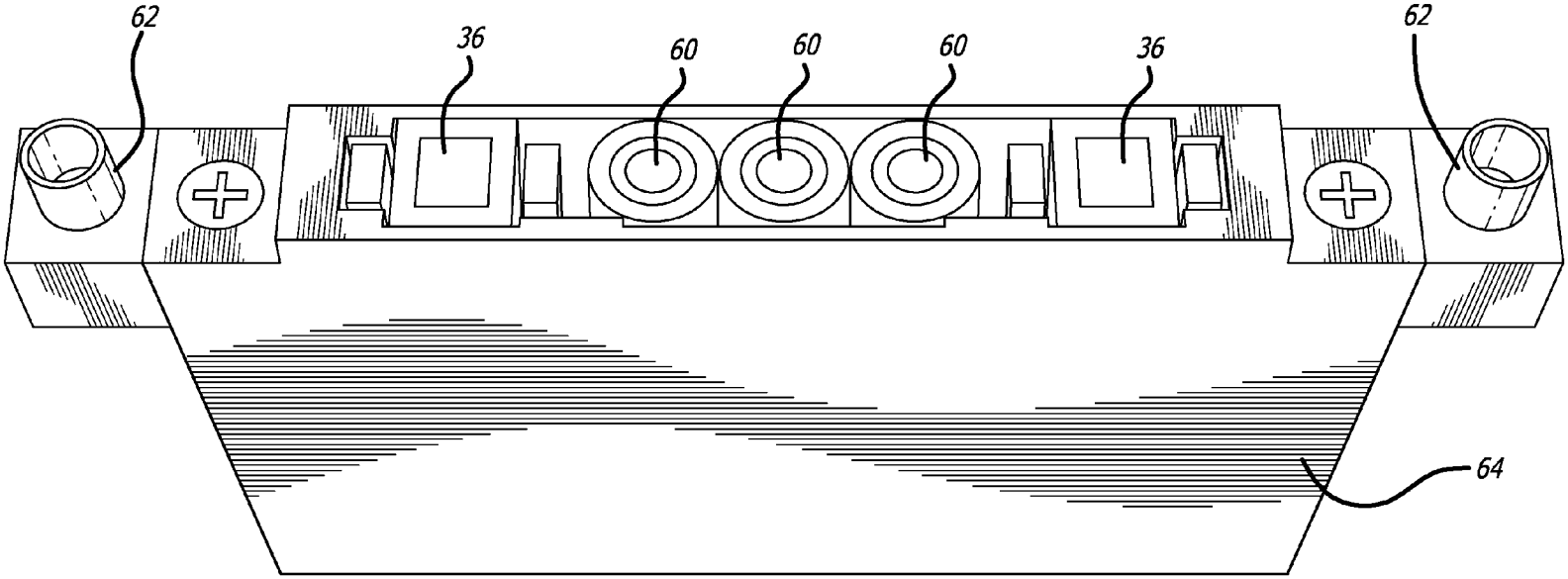
FIG. 6 is a view of the connector edge of the module without the protective layer over the assembly so as to illustrate the arrangement of the E-core and I-core assemblies.

FIG. 5 is a perspective view of a module connector E-core and I-core assemblies on an edge of a circuit board in the module, and FIG. 6 is a view of the connector edge of the module without the protective layer over the assembly so as to illustrate the arrangement of the E-core and I-core assemblies, which assemblies are not visible with the protective layer in place. In that regard, such protective layer in one embodiment is another 0.005 inch thick Lexan sheet fastened in position around its edges to a floating support, which leaves sufficient flexibility for the application. Also visible in FIG. 6 are the mounting screw holes surrounded by projections 62 which fit into corresponding holes in the backplane assembly for accurately locating the module on the backplane assembly. Projection 62 and the holes in the backplane assembly may be the same, or may be purposely made of different shapes or diameters, etc. to prevent mounting the module backward or upside down.

Figure 7:
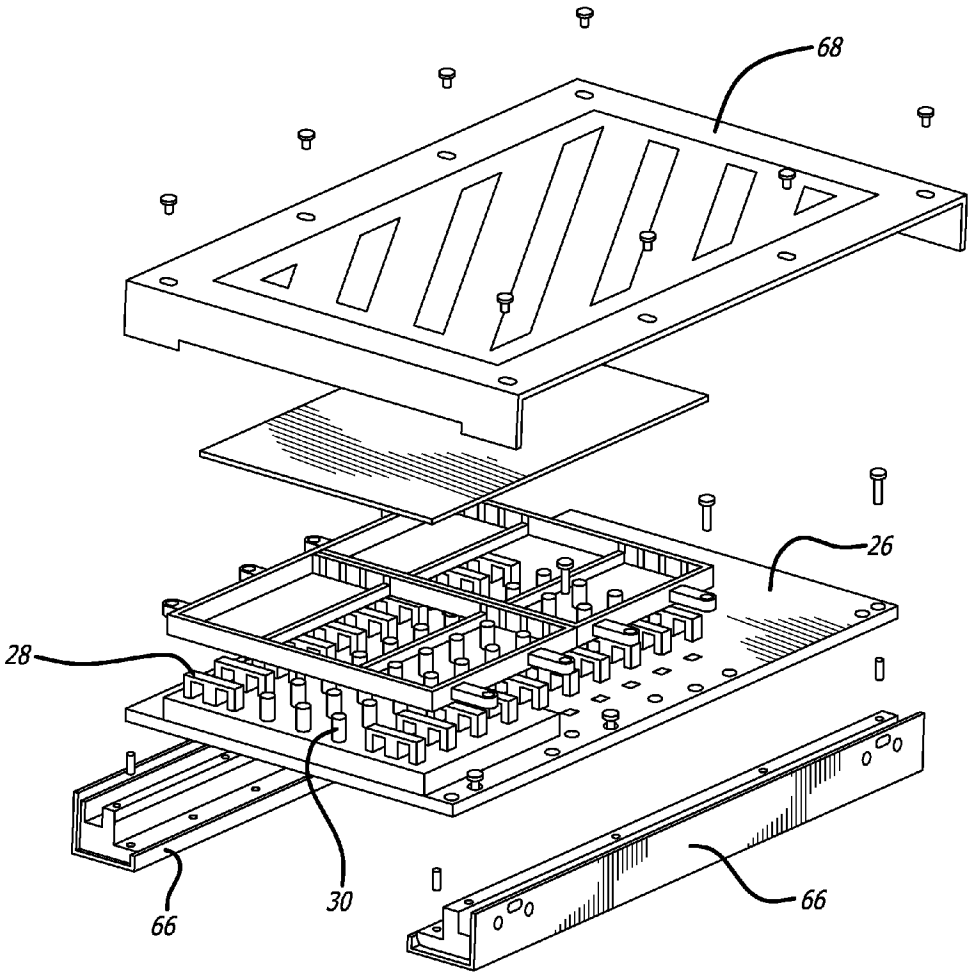
FIG. 7 is a view of the connector edge of the module without the protective layer over the assembly so as to illustrate the arrangement of the E-core and I-core assemblies.
Figure 8:
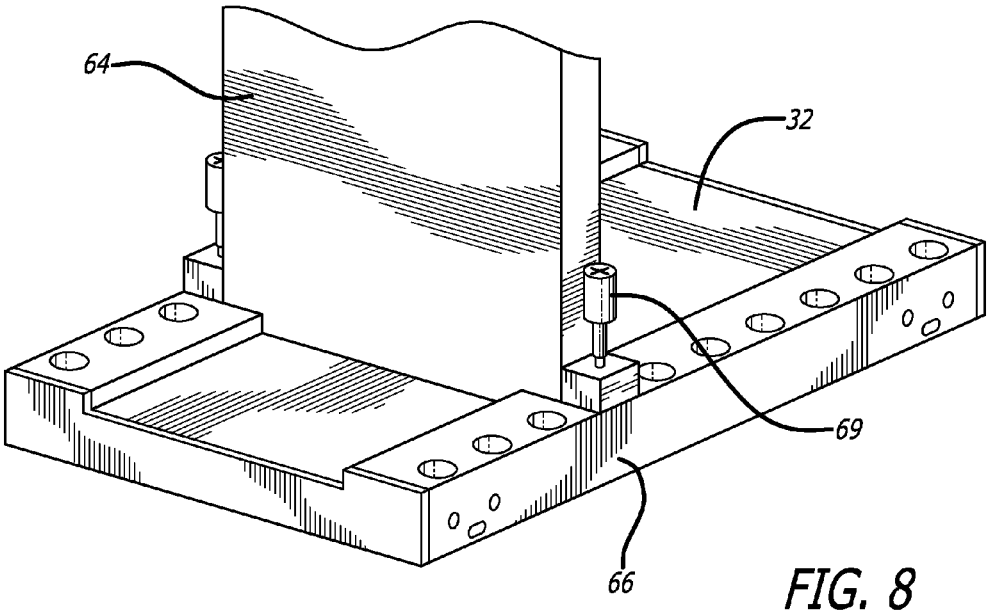
FIG. 8 shows a module mounted by screws in a slot of the backplane assembly.

The final assembly of an exemplary embodiment is illustrated in FIGS. 7 and 8. FIG. 7 is an exploded view of the backplane assembly comprising the backplane circuit board 26 with the E-cores 28 and I-cores 30 thereon, the backplane rails 66 and cover 68 protecting the back of the backplane circuit board 26. FIG. 8 shows a module 64 mounted in slot 4 of the backplane assembly by screws 69. The label 32 covers the backplane circuit board 26 and identifies the slots by number.

Figure 3B:
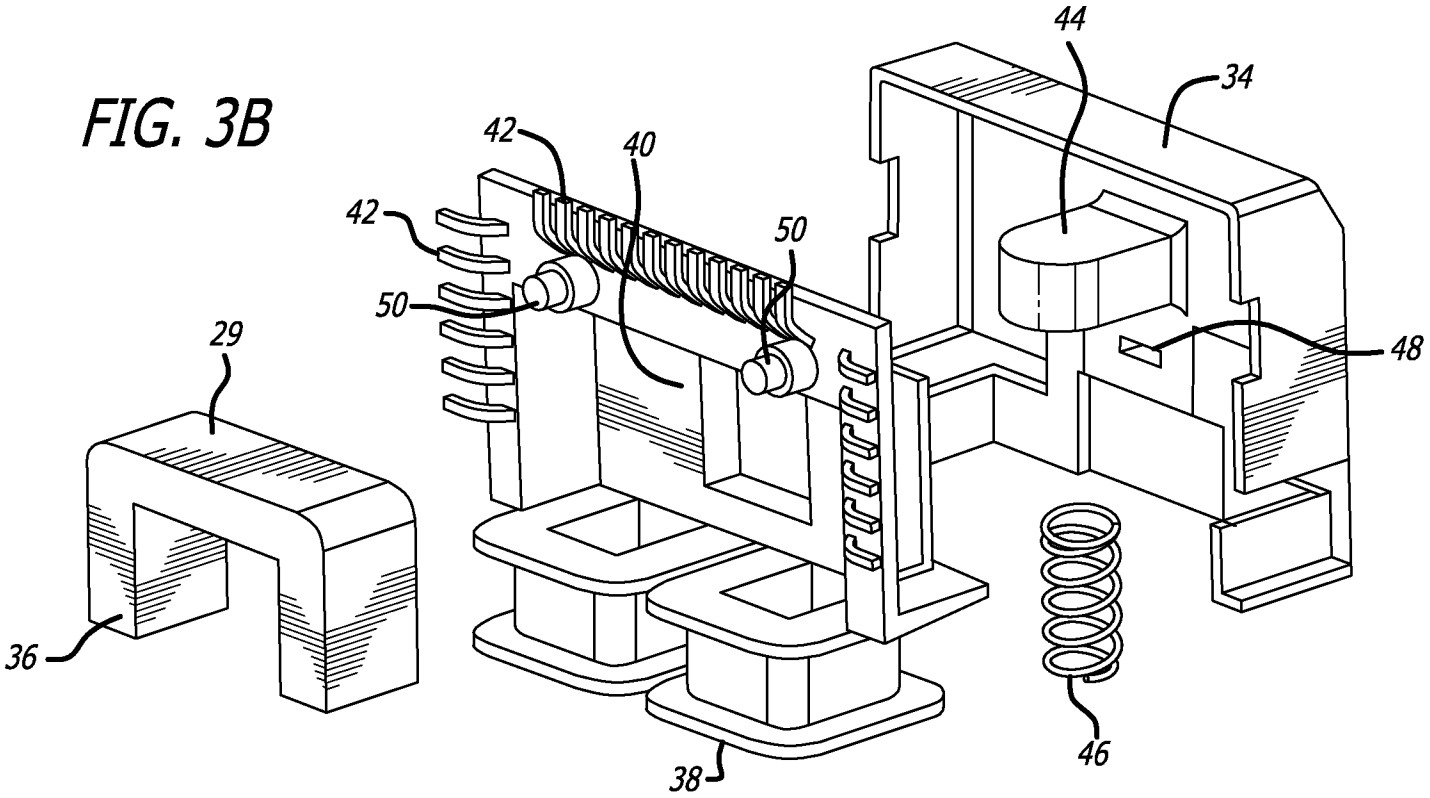
FIG. 3B schematically illustrates the use of C-cores for the E-cores in the assembly of FIG. 3A.

In the embodiment hereinbefore described, E-cores and I-cores were used for the coupling of power and signals, respectively. The use of I-cores is highly desirable for signals, as they perform well at the high frequencies used for signal transmission (preferably using Manchester or other coding having a zero DC value), and package compactly in a final connector assembly, though other shaped cores could be used if desired. For the E-cores, another alternative would be to use C-cores, such as shown in schematic form in FIG. 3B. Here the planar windings on the backplane and the wire wound windings 38 on the module connector are on both legs of the C-cores 29, though these windings 38 could be on one leg only. If such windings were on one leg only, they should be on the same leg, not on opposite legs, to minimize flux leakage. Otherwise the assemblies are as described herein.

In the foregoing description, nothing has been said about shielding to prevent crosstalk between communication channels or electromagnetic radiation in general, though shielding is desirable, if not required. Because of the frequencies typically used for electromagnetic connectors in accordance with the present invention, shielding is best provided by conductive enclosures rather than magnetic enclosures, particularly for the I-cores. Such conductive enclosures may be provided, for example, by aluminum stampings or metal plated plastic enclosures. For the I-cores, since the magnetic circuit partially defined by the I-cores is completed by the nonmagnetic space around the I-cores, any such shielding should be spaced somewhat away from the I-cores so as to not choke off that space, but instead only contain the much lower flux density that would otherwise extend outward in significant strength over greater distances. As part of that shielding, the planar windings for the I-cores on the backplane circuit board include a grounded ring encircling the face of each respective I-core, but spaced outward to allow space for the flux as described.

Also in the foregoing description, electromagnetic connectors using two E-cores assemblies and three I-core assemblies are shown. In this exemplary embodiment, the E-core assemblies are essentially identical, one serving as the primary source of power for the module and the other serving as a backup source of power for the module. For the three I-core assemblies, one provides communication from the backplane to the module, one provides communication from the module to the backplane, and one provides a lower frequency bidirectional communication for such purposes as monitoring and supervisory functions. Obviously the use of two electromagnetic power transfer assemblies and three electromagnetic communication assemblies is application dependent, and fewer or more such assemblies may be used as required.

One aspect of a practical embodiment is the detection of the presence or absence of a module in a particular "slot" on the backplane. Obviously a switch on the backplane could be used, though in general this would not be allowed, and further would itself constitute a failure prone component in what would and should be a high reliability connector. Instead, in one embodiment, the slot is periodically pinged when a module is not present by very temporarily powering the slot (an E-core primary planar winding or both E-core primary windings) and sensing the apparent inductance or impedance of the primary planar winding. If no module is present, the inductance will be very low, and the impedance will also be very low, not much more than the resistance of the respective E-core planar winding. By pinging both E-core primary windings, the presence of a module may be sensed, even in the presence of a shorted wire wound secondary on one of the S-cores in the module (or backplane), or an open primary on one of the E-core planar windings by sensing no current when pinged, allowing disabling of the affected C-core pair, flagging the failure and continuing operation of the module using the other pair of E-cores for powering the module. Removal (or certain failures) of a module may be similarly detected by detecting a planar primary of one or both E-cores that is above the maximum allowed for a properly functioning module properly mounted to the backplane.

Figure 9:
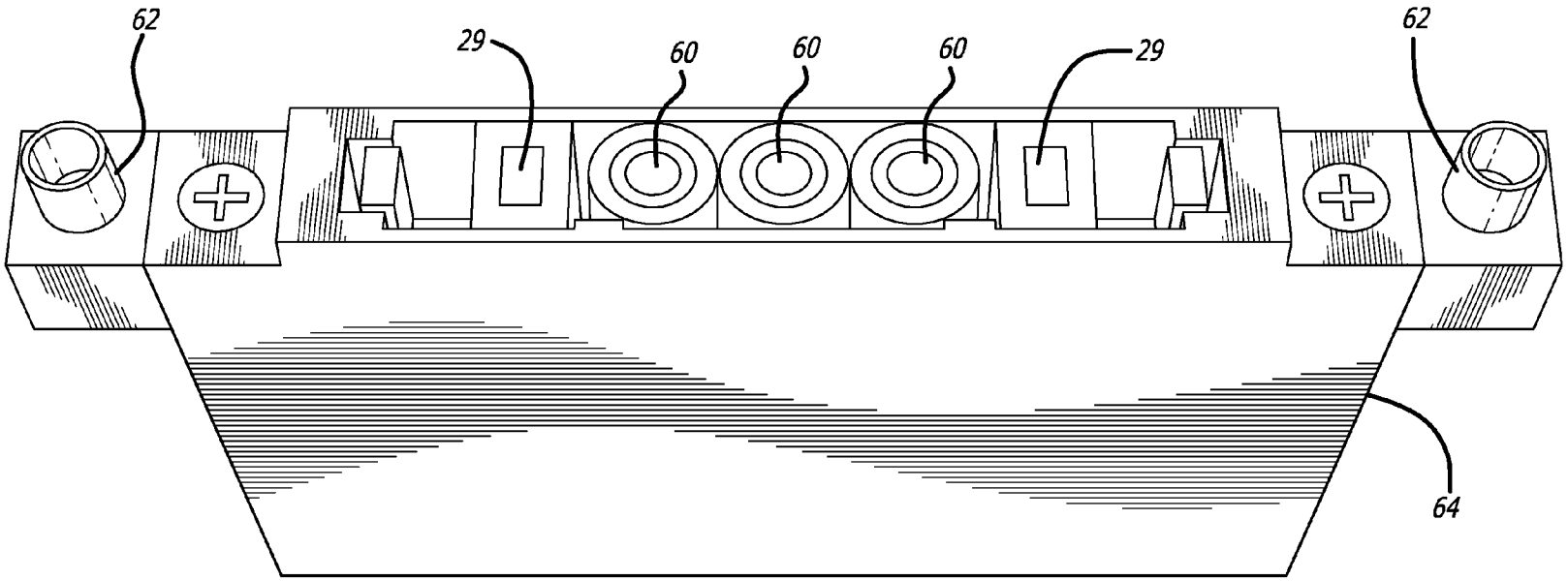
FIG. 9 is an illustration of the rear of a module using C-cores for the power connection of the connector.
Figure 10:
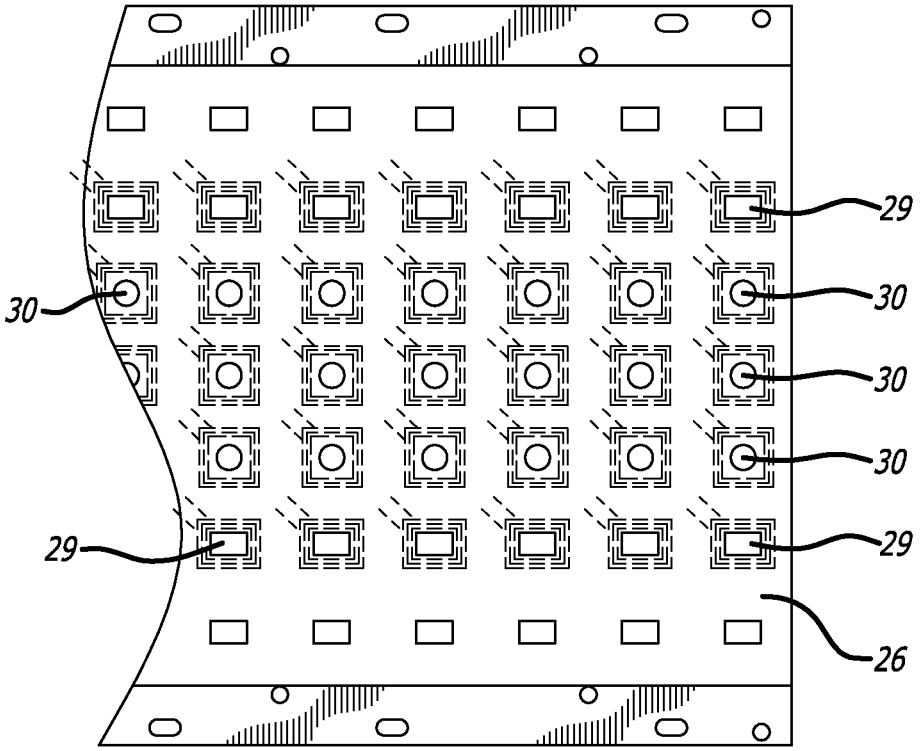
FIG. 10 is an illustration of a backplane using C-cores for the power connection of the connector.

FIG. 9 is an illustration of the rear of a module using C-cores 29 for the power connection of the connector, and FIG. 10 is an illustration of a backplane using corresponding C-cores 29, in both cases the C-cores replacing the E-cores 28. In that regard, it is to be noted that the term E-core is used herein and in the claims in a general sense to mean a magnetic core that has a cross section in the form of an E. This definition covers not only the E-core configuration shown herein, but also cores having a configuration of a surface of revolution or partial surface of revolution generated by rotating an E-core about the axis of its center leg. Any such E-core would have to have an outer edge interrupted to allow the planar windings on the backplane to extend into the space between the center and the rim of the surface of revolution and to allow the exit of the wires on the windings in the module, but otherwise would function properly.

In some embodiments, the symmetry of the I-cores and the E-cores or C-cores allows the module to be assembled into a slot on the backplane with either orientation. By way of example, in some embodiments, the module is comprised to two identical circuits to provide a backup circuit if the one being used fails, or for both to operate so that a failure can be detected by the two having different results. Either way, the center I-core assembly can be used to talk to the module, and the other 2 I-core assemblies used for the module to talk to the backplane. Because of the symmetry, it doesn't matter which circuit is to talk to the backplane through which of the two I-core assemblies. Even if the circuitry in the module is not symmetrical, when the presence of a module is detected on insertion of a module, the module needs to be pinged for the module to identify itself. Incorporated in that circuitry and process can be a detection of a response tailored to identify the module orientation, after which the circuitry in the module or coupled to the backplane may reroute power and/or signals as appropriate.

Thus the present invention has a number of aspects, which aspects may be practiced alone or in various combinations or sub-combinations, as desired. While certain preferred embodiments of the present invention have been disclosed and described herein for purposes of illustration and not for purposes of limitation, it will be understood by those skilled in the art that various changes in form and detail may be made therein without departing from the spirit and scope of the invention as defined by the full breadth of the following claims.

What is claimed is:

1. A module to be mounted on a backplane for transferring power and furnishing communications between the module and the backplane, the module comprising:

a first magnetic E-core for transferring power between the module and the backplane, the first magnetic E-core having a center leg and first and second outer legs, the center leg and the first and second outer legs of the first magnetic E-core being joined at a first end thereof and being mounted with a second end thereof adjacent an end of the module, the module having at least one wound coil encircling at least one of the center leg and the first and second outer legs of the first magnetic E-core, the second end of the first magnetic E-core having a protective sheet or layer thereover, the first magnetic E-core to meet with a second magnetic E-core having a center leg and first and second outer legs, the center leg and the first and second outer legs of the second magnetic E-core being joined at one end thereof and being mounted with a second end thereof extending into openings in the backplane, the backplane having a printed coil encircling at least one of the center leg and the first and second outer legs of the second magnetic E-core; and a first magnetic I-core for furnishing communication between the module and the backplane, the first magnetic I-core having an end thereof mounted adjacent the end of the module, the module having at least one wound coil encircling the first magnetic I-core, the first magnetic I-core to meet with a second magnetic I-core mounted with an end thereof extending into an opening in the backplane, the backplane having a printed coil encircling the second magnetic I-core;

the module being configured so that the second end of each leg of the first magnetic E-core is aligned with the corresponding leg of the second magnetic E-core and the end of the first magnetic I-core is adjacent the end of the second magnetic I-core when the module is mounted to the backplane, wherein the first magnetic E-core is loaded to protrude from a mounting plane of the module, and the first magnetic I-core is positively mounted to a circuit board in the module.

2. The module of claim 1 wherein the at least one wound coil in the module is a coil with multiple taps.

3. The module of claim 1 wherein the second end of the second magnetic E-core in the backplane does not protrude from a module side of the backplane.

4. The module of claim 3 wherein the first magnetic E-core in the module is spring mounted to provide a spring force between the first magnetic E-core in the module and the second magnetic E-core in the backplane when the module is mounted to the backplane.

5. The module of claim 1 wherein the first and second magnetic E-cores are ferrite E-cores.

6. The module of claim 1 further comprising:

at least a third magnetic E-core, the third magnetic E-core mounted adjacent the end of the module like the first magnetic E-core to meet with a fourth magnetic E-core on the backplane like the second magnetic E-core;

at least a third magnetic I-core, the third magnetic I-core mounted adjacent the end of the module like the first magnetic I-core to meet with a fourth magnetic I-core on the backplane like the second magnetic I-core;

the first and second magnetic E-cores being mounted symmetrically with the third and fourth magnetic E-cores about a center of the module; and the first and second magnetic I-cores being mounted symmetrically with the third and fourth magnetic I-cores about a center of the module;

wherein the module will be functional when mounted to the backplane in a first relative orientation, or a second relative orientation reversed from the first relative orientation.

7. The module of claim 1 wherein the module contains two identical circuits.

8. The module of claim 1 further comprising circuitry for sensing the relative orientation of the module and rerouting power and/or signals.

9. The module of claim 1 wherein the end of the second magnetic I-core in the backplane does not protrude from the module side of the backplane.

10. The module of claim 1 wherein the end of the first magnetic I-core has a protective sheet or layer thereover.

11. The module of claim 1 wherein the second magnetic I-core in the backplane is positively mounted in the backplane.

12. The module of claim 11 wherein the second magnetic I-core in the backplane is mounted in the backplane with an axis of the second magnetic I-core perpendicular to the backplane, and wherein the first magnetic I-core in the module is mounted with an axis substantially collinear with the axis of the second magnetic I-core in the backplane when the module is mounted to the backplane.

13. The module of claim 12 wherein the first and second magnetic I-cores are mounted so that when the module is mounted to the backplane, the ends of the first and second magnetic I-cores are in close proximity without subjecting each other to a mechanical force along their axes.

14. The module of claim 1 wherein the first and second magnetic I-cores are ferrite I-cores.

15. The module of claim 1 wherein both the first and second magnetic E-cores and the first and second magnetic I-cores are ferrite cores, the first and second magnetic E-cores being of one grade of ferrite and the first and second magnetic I-cores being of a second grade of ferrite different from the first grade.

16. A module to be mounted on a backplane for transferring power and furnishing communications between the module and the backplane, the module comprising:

a first magnetic C-core for transferring power between the module and the backplane, the first magnetic C-core having first and second legs, the first and second legs of the first magnetic C-core being joined at a first end thereof and being mounted with a second end thereof adjacent an end of the module, the module having at least one wound coil encircling at least one of the first and second legs of the first magnetic C-core, the second end of the first magnetic C-core having a protective sheet or layer thereover, the first magnetic C-core to meet with a second magnetic C-core having first and second legs, the first and second legs of the second magnetic C-core being joined at one end thereof and being mounted with a second end thereof extending into openings in the backplane, the backplane having a printed coil encircling at least one of the first and second legs of the second magnetic C-core; and a first magnetic I-core for furnishing communication between the module and the backplane, the first magnetic I-core having an end thereof mounted adjacent the end of the module, the module having at least one wound coil encircling the first magnetic I-core, the first magnetic I-core to meet with a second magnetic I-core mounted with an end thereof extending into an opening in the backplane, the backplane having a printed coil encircling the second magnetic I-core;

the module being configured so that the second end of each leg of the first magnetic C-core is aligned with the corresponding leg of the second magnetic C-core and the end of the first magnetic I-core is adjacent the end of the second magnetic I-core when the module is mounted to the backplane, wherein the first magnetic C-core is loaded to protrude from a mounting plane of the module, and the first magnetic I-core is positively mounted to a circuit board in the module.

17. The module of claim 16 wherein the at least one wound coil in the module is a coil with multiple taps.

18. The module of claim 16 wherein the second end of the second magnetic C-core in the backplane does not protrude from a module side of the backplane.

19. The module of claim 18 wherein the first magnetic C-core in the module is spring mounted to provide a spring force between the first magnetic C-core in the module and the second magnetic C-core in the backplane when the module is mounted to the backplane.

20. The module of claim 16 wherein the first and second magnetic C-cores are ferrite C-cores.

21. The module of claim 16 further comprising:

at least a third magnetic C-core, the third magnetic C-core mounted adjacent the end of the module like the first magnetic C-core to meet with a fourth magnetic C-core on the backplane like the second magnetic C-core;

at least a third magnetic I-core, the third magnetic I-core mounted adjacent the end of the module like the first magnetic I-core to meet with a fourth magnetic I-core on the backplane like the second magnetic I-core;

the first and second magnetic C-cores being mounted symmetrically with the third and fourth magnetic C-cores about a center of the module; and the first and second magnetic I-cores being mounted symmetrically with the third and fourth magnetic I-cores about a center of the module;

wherein the module will be functional when mounted to the backplane in a first relative orientation, or a second relative orientation reversed from the first relative orientation.

22. The module of claim 21 wherein the module contains two identical circuits.

23. The module of claim 21 further comprising circuitry for sensing the relative orientation of the module and rerouting power and/or signals.

24. The module of claim 16 wherein the end of the second magnetic I-core in the backplane does not protrude from the module side of the backplane.

25. The module of claim 16 wherein the end of the first magnetic I-core has a protective sheet or layer thereover.

26. The module of claim 16 wherein the second magnetic I-core in the backplane is positively mounted in the backplane.

27. The module of claim 26 wherein the second magnetic I-core in the backplane is mounted in the backplane with an axis of the second magnetic I-core perpendicular to the backplane, and wherein the first magnetic I-core in the module is mounted with an axis substantially collinear with the axis of the second magnetic I-core in the backplane when the module is mounted to the backplane.

28. The module of claim 27 wherein the first and second magnetic I-cores are mounted so that when the module is mounted to the backplane, the ends of the first and second magnetic I-cores are in close proximity without subjecting each other to a mechanical force along their axes.

29. The module of claim 16 wherein the first and second magnetic I-cores are ferrite I-cores.

30. The module of claim 16 wherein both the first and second magnetic C-cores and the first and second magnetic I-cores are ferrite cores, the first and second magnetic C-cores being of one grade of ferrite and the first and second magnetic I-cores being of a second grade of ferrite different from the first grade.

31. A method of coupling power from a backplane to a module to be coupled to the backplane and furnishing communications between the module and the backplane, the method comprising:

mounting at least one of a first magnetic C-core or E-core on a backplane circuit board for transferring power between the module and the backplane, the first magnetic C-core or E-core with faces thereof extending into openings in the backplane circuit board, the backplane circuit board having at least one planar coil encircling at least one leg of the at least one of the first magnetic C-core or E-core;

providing at least one of a second magnetic C-core or E-core mounted in a module for transferring power between the module and the backplane, the second magnetic C-core or E-core with faces thereof adjacent a module surface, the module having a wire wound coil encircling at least one leg of the at least one of the second magnetic C-core or E-core, an end of the at least one of the second magnetic C-core or E-core adjacent an end of the module having a protective sheet or layer thereover, the at least one of the second magnetic C-core or E-core loaded to protrude from a mounting plane of the module;

mounting a first magnetic I-core for furnishing communication between the module and the backplane, the first magnetic I-core with an end thereof passing through an opening in the backplane circuit board, the backplane circuit board having a printed coil encircling the first magnetic I-core; and providing a second magnetic I-core for furnishing communication between the module and the backplane, the second magnetic I-core with an end thereof adjacent the end of the module, the module having at least one wound coil encircling the second magnetic I-core, the second magnetic I-core positively mounted to a circuit board in the module;

wherein when the module is coupled to the backplane, the faces of the at least one of the second magnetic C-core or E-core on the module will be adjacent to the faces of the at least one of the first magnetic C-core or E-core, and the end of the second magnetic I-core will be adjacent to the end of the first magnetic I-core.

32. The method of claim 31 wherein the wire wound coil on the at least one of the second magnetic C-core or E-core is provided with multiple taps.

33. The method of claim 31 wherein the at least one of the first magnetic C-core or E-core in the backplane does not protrude from a module side of the backplane.

34. The method of claim 33 further comprising spring mounting the at least one of the second magnetic C-core or E-core in the module to provide a spring force between the at least one of the first magnetic C-core or E-core in the module and the at least one of the second magnetic C-core or E-core in the backplane when the module is mounted to the backplane.

35. The method of claim 31 wherein the at least one of the first magnetic C-core or E-core and the at least one of the second magnetic C-core or E-core are ferrite cores.

36. The method of claim 31 further comprising:

providing at least one of a third magnetic C-core or E-core;

providing at least one of a fourth magnetic C-core or E-core;

configuring the at least one of the third magnetic C-core or E-core like the at least one of the first magnetic C-core or E-core and the at least one of the fourth magnetic C-core or E-core like the at least one of the second magnetic C-core or E-core;

providing at least third and fourth magnetic I-cores;

configuring the third magnetic I-core like the first magnetic I-core and the fourth magnetic I-core like the second magnetic I-core;

mounting the at least one of the third magnetic C-core or E-core symmetrically with the at least one of the first magnetic C-core or E-core and the at least one of the fourth magnetic C-core or E-core symmetrically with the at least one of the third magnetic C-core or E-core about a center of the module; and mounting the third and fourth magnetic I-cores symmetrically with the first and second magnetic I-cores about the center of the module;

wherein the module will be functional when mounted to the backplane in a first relative orientation, or a second relative orientation reversed from the first relative orientation.

37. The method of claim 36 wherein the module contains two identical circuits.

38. The method of claim 36 wherein the module includes circuitry for sensing the relative orientation of the module and rerouting power and/or signals.

39. The method of claim 31 wherein the first magnetic I-core is mounted so that the end of the first magnetic I-core in the backplane does not protrude from a module side of the backplane.

40. The method of claim 31 further comprising providing a protective sheet or layer over the ends of each of the first and second magnetic I-cores.

41. The method of claim 31 wherein the first magnetic I-core in the backplane is positively mounted in the backplane.

42. The method of claim 41 wherein the first magnetic I-core in the backplane is mounted in the backplane with an axis of the first magnetic I-core perpendicular to the backplane, and wherein the second magnetic I-core in the module is mounted with an axis substantially collinear with the axis of the first magnetic I-core in the backplane when the module is mounted to the backplane.

43. The method of claim 42 wherein the first and second magnetic I-cores are mounted so that when the module is mounted to the backplane, the ends of the first and second magnetic I-cores are in close proximity without subjecting each other to a mechanical force along their axes.

44. The method of claim 31 wherein the first and second magnetic I-cores are ferrite I-cores.

45. The method of claim 31 wherein both the at least one of the first magnetic C-core or E-core and the at least one of the second magnetic C-core or E-core, and the first and second magnetic I-cores are ferrite cores, the at least one of the first magnetic C-core or E-core and the at least one of the second magnetic C-core or E-core being of one grade of ferrite and the first and second magnetic I-cores being of a second grade of ferrite different from the first grade of ferrite.

46. A connector for signal transmission for at least one of a backplane to a module mounted on the backplane, and a module to a backplane to which the module is mounted, and for transferring power between the module and the backplane, the connector comprising:

at least one of a first magnetic C-core or E-core and at least one of a second magnetic C-core or E-core for transferring power between the module and the backplane;

the at least one of the first magnetic C-core or E-core being mounted on a backplane with faces thereof extending into openings in the backplane, the backplane having at least one planar coil encircling at least one leg of the at least one of the first magnetic C-core or E-core;

the at least one of the second magnetic C-core or E-core being mounted in a module with faces thereof adjacent a module surface, the module having a wire wound coil encircling at least one leg of the at least one of the second magnetic C-core or E-core, an end of the at least one of the second magnetic C-core or E-core adjacent an end of the module having a protective sheet or layer thereover, the at least one of the second magnetic C-core or E-core loaded to protrude from a mounting plane of the module;

first and second magnetic I-cores for furnishing communication between the module and the backplane;

the first magnetic I-core being mounted with an end thereof passing into an opening in the backplane, the backplane having a printed coil encircling the first magnetic I-core;

the second magnetic I-core having an end thereof adjacent the end of the module, the module having at least one wound coil encircling the second magnetic I-core, the second magnetic I-core positively mounted in the module;

the backplane and the module also being configured so that the faces of the at least one of the first magnetic C-core or E-core are adjacent the faces of the at least one of the second magnetic C-core or E-core and the end of the first magnetic I-core is adjacent the end of the second magnetic I-core when the module is mounted to the backplane.

47. The connector of claim 46 further comprising:

at least third and fourth magnetic I-cores, the third magnetic I-core on the backplane like the first magnetic I-core and the fourth magnetic I-core mounted adjacent the end of the module like the second magnetic I-core;

the first and second magnetic I-cores being mounted symmetrically with the third and fourth magnetic I-cores about a center of the module;

wherein the connector will be functional when the module is mounted to the backplane in a first relative orientation, or a second relative orientation reversed from the first relative orientation.

48. The connector of claim 47 wherein the module contains two identical circuits.

49. The connector of claim 47 wherein the module includes circuitry for sensing the relative orientation of the module and rerouting signals.

50. The connector of claim 46 wherein the end of the first magnetic I-core in the backplane does not protrude from a module side of the backplane.

51. The connector of claim 46 wherein the ends of each of the first and second magnetic I-cores have a protective sheet or layer thereover.

52. The connector of claim 46 wherein the first magnetic I-core in the backplane is mounted in the backplane with an axis of the first magnetic I-core perpendicular to the backplane, and wherein the second magnetic I-core in the module is mounted with an axis substantially collinear with the axis of the first magnetic I-core in the backplane when the module is mounted to the backplane.

53. The connector of claim 52 wherein the first and second magnetic I-cores are mounted so that when the module is mounted to the backplane, the first and second magnetic I-cores are in close proximity without subjecting each other to a mechanical force along their axes.

54. The connector of claim 46 wherein the first and second magnetic I-cores are ferrite I-cores.

* * * * *